United States Patent [19]

Leifeld

[11] Patent Number: 4,523,351

[45] Date of Patent: Jun. 18, 1985

[54] FIBER LAP PRODUCING APPARATUS WITH LAP WIDTH VARYING DEVICE

[75] Inventor: Ferdinand Leifeld, Kempen, Fed. Rep. of Germany

[73] Assignee: Trützschler GmbH & Co. KG, Monchen-Gladbach, Fed. Rep. of Germany

[21] Appl. No.: 450,421

[22] Filed: Dec. 16, 1982

[30] Foreign Application Priority Data

Dec. 17, 1981 [DE] Fed. Rep. of Germany ..... 3149965

[51] Int. Cl.[3] ..... D01G 15/40

[52] U.S. Cl. ..... 19/105; 19/304

[58] Field of Search ..... 19/105, 64.5, 97.5, 19/288, 304; 193/2 C, 25 R, 25 C; 209/146, 149, 154; 406/182

[56] References Cited

U.S. PATENT DOCUMENTS

| | | | |
|---|---|---|---|
| 2,845,661 | 8/1958 | Svende et al. | 19/304 |
| 3,070,847 | 1/1963 | Schwab | 19/105 |
| 3,103,040 | 9/1963 | Duquette | 19/105 X |
| 3,728,759 | 4/1973 | Hergeth | 19/105 |
| 3,963,111 | 6/1976 | Harrell | 19/105 X |
| 4,009,803 | 3/1977 | Lytton et al. | 19/105 X |
| 4,280,251 | 7/1981 | Ludwig | 19/105 X |

FOREIGN PATENT DOCUMENTS

| | | | |
|---|---|---|---|
| 1286436 | 1/1969 | Fed. Rep. of Germany . | |
| 2248522 | 4/1974 | Fed. Rep. of Germany . | |
| 2638353 | 3/1978 | Fed. Rep. of Germany . | |
| 2939968 | 4/1981 | Fed. Rep. of Germany | 19/105 |

*Primary Examiner*—Louis K. Rimrodt

*Attorney, Agent, or Firm*—Spencer & Frank

[57] ABSTRACT

An apparatus for producing a fiber lap includes a generally vertically oriented feed chute in which fiber tufts are introduced at the top and from which a fiber lap is discharged at the bottom. There is provided a movable wall element for varying an effective width of the feed chute for altering the width of the fiber lap produced by the apparatus.

16 Claims, 8 Drawing Figures

FIBER LAP PRODUCING APPARATUS WITH LAP WIDTH VARYING DEVICE

BACKGROUND OF THE INVENTION

This invention relates to an apparatus which is connected to a rollercard unit or carding machine upstream thereof for producing a fiber lap. The apparatus includes a feed chute into which fiber tufts are introduced at the top and are withdrawn as a fiber lap from the bottom. During this operation, an air stream enters the feed chute which exits therefrom through air exit openings provided in walls of the feed chute.

In practice, it is often a desideratum to obtain a fiber lap of different widths. If, for example, a changeover in the product occurs, it may be required to vary the lap width. According to known methods, the lap is brought to the desired width by cutting, blowing or suction, wherein the excessive material removed from the lap sides is reintroduced into the feed chute and is caused to participate again in the lap formation. It is a disadvantage of such an arrangement that it requires a certain additional technological input and further that the reintroduced lap edge portions pass more than once through lap formation and therefore may cause undesirable changes in the lap structure.

SUMMARY OF THE INVENTION

It is an object of the invention to provide an improved apparatus of the above-outlined type by means of which a fiber lap can be produced with easily variable width without removing material from the lap sides.

This object and others to become apparent as the specification progresses, are accomplished by the invention, according to which, briefly stated, the feed chute has at least one laterally displaceable wall element for varying the width of the fiber lap discharge opening of the feed chute, whereby the width of the delivered fiber tuft lap is varied.

By means of the arrangement according to the invention, it is feasible to produce fiber laps of different widths without the need of removing excessive marginal portions of the fiber lap. The laterally displaceable wall element is arranged immediately at the marginal zone of the lap and thus determines the width thereof.

According to a further feature of the invention, in a lap forming apparatus having an upper reserve chute and a lower feed chute, the lap width is expediently set in the lower feed chute. For this purpose, in the zone of the lateral feed chute wall, an obliquely downwardly oriented, angularly settable plate is provided which extends from the side wall to the air exit openings and the delivery rollers arranged at the discharge opening of the feed chute. The plate sealingly adjoins the lateral wall of the feed chute. The plate may have a U-shaped configuration whereby a sealing effect with respect to the front and rear walls of the lower feed chute is also achieved. By displacing the plate which practically in each position forms the hypotenuse of a triangle whose short sides are formed by the side wall and the delivery rollers, the position of the lap edge, that is, the lap width, may be varied in a stepless manner. Thus, the width and the position of the lap can be infinitely varied within the setting limits of the displaceable wall element.

In case the lap forming apparatus delivers divided laps, according to the invention several laps of variable width may be obtained. For such a case, the lap divider is provided with the obliquely oriented plates or the lap divider is itself so structured that the separating walls can be pivoted and displaced obliquely. The plates may be set and immobilized from the outside of the lower feed chute in case a constant lap width is required for a certain production period. For producing laps of predetermined shape, the wall elements can be displaced during operation. By coordinating the delivery roller speed with the motion of the wall elements, a desired number of different lap shapes may be obtained. This may lead to a reduction of waste during a subsequent lap cutting operation.

DESCRIPTION OF THE PREFERRED EMBODIMENTS

Figure 1:
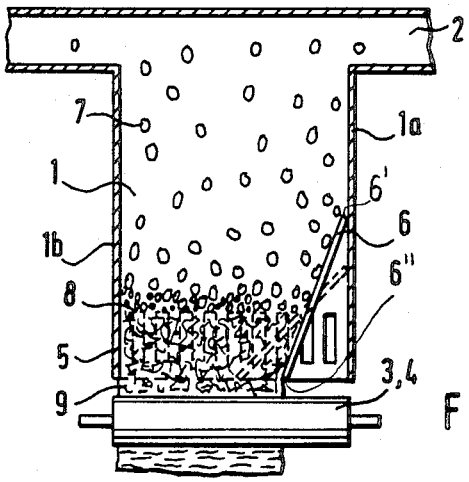
FIG. 1 is a schematic front elevational view of a preferred embodiment of the invention.

Turning to FIG. 1, there is shown a feed chute 1 which, at its upper inlet opening for the fiber tufts is in communication with a pneumatic conveyor duct 2 and which, at its lower output end is provided with two delivery rollers 3, 4. In at least one chute wall, preferably in the lower zone of the front or rear wall, up to a certain height air outlet openings 5 are provided which may be constituted by a comb-like structure known by itself and disclosed, for example, in German Auslegeschrift (Application Published after Examination) No. 1,286,436.

In the feed chute 1 there is arranged a wall element 6, for example, a sheet metal plate whose width extends from the front wall to the rear wall of the chute 1. The upper end 6' of the plate 6 is associated with a lateral wall 1*a* of the feed chute 1 while the lower end 6'' of the plate 6 is associated with the lower end of the chute 1, immediately above the delivery rollers 3 and 4. At its lower end 6'' the wall element 6 is at a distance from the lateral wall 1*a* and thus the wall element 6 extends obliquely downwardly towards the oppositely located chute side wall 1*b* from which the lower end 6'' is spaced as well. The wall element 6 may be displaced from a relatively steep position (shown in solid lines in FIG. 1) to a less steep position (shown in broken lines in FIG. 1) so that the fiber lap 9 discharged by the feed chute 1 may be varied in width. The upper zone of the wall element 6 reaches into the upper zone of the feed chute 1. The fiber tufts 7 fly as individual tufts downwardly through the major part of the feed chute 1. The width of their path is gradually reduced by the wall element 6 to prevent the tufts 7 from a premature bunching. There occurs only in the lower part of the feed chute 1 a fiber tuft accumulation (filling) 8 of the superimposed fiber tufts which are, from above, pneumatically densified by an air stream. The tuft filling 8 covers the air outlet openings 5. The air stream exits from the feed chute 1 through the air outlet openings 5. The densified fiber tuft filling 8 is withdrawn as a fiber lap 9 from the lower end of the feed chute 1 by means of the delivery rollers 3 and 4.

Figure 2:
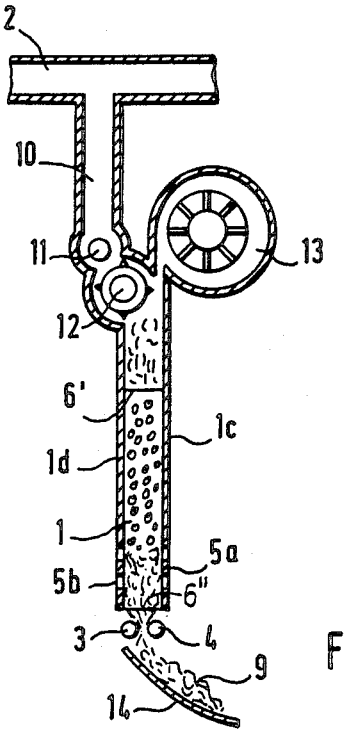
FIG. 2 is a schematic sectional elevational view of another preferred embodiment of the invention.

Turning now to FIG. 2, between the conveyor duct 2 and the lower feed chute 1 there is arranged an upper chute 10, from which the fibers are advanced into the feed chute 1 by means of a feed roller 11 and an opening roller 12. At the upper end of the feed chute 1 a fan 13 is arranged which directs an air stream into the feed chute 1. In the front wall 1*c* and the rear wall 1*d* of the feed chute 1 respective air outlet openings 5*a* and 5*b* are provided. The wall element 6 has upper and lower edges 6′ and 6″ which extend from the front wall 1*c* to the rear wall 1*d*. Underneath the delivery rollers 3 and 4 there is arranged a guide tray 14 for the lap 9.

Figure 3:
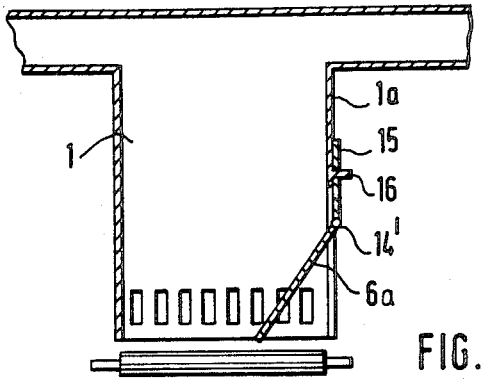
FIG. 3 is a schematic front elevational view of another preferred embodiment of the invention.

Turning to FIG. 3, the wall element 6*a* is, at its upper edges, articulated at 14 to a vertical support plate 15 which is vertically displaceably connected with the stationary lateral wall 1*a* of the feed chute with the intermediary of a mounting element 16.

Figure 4:
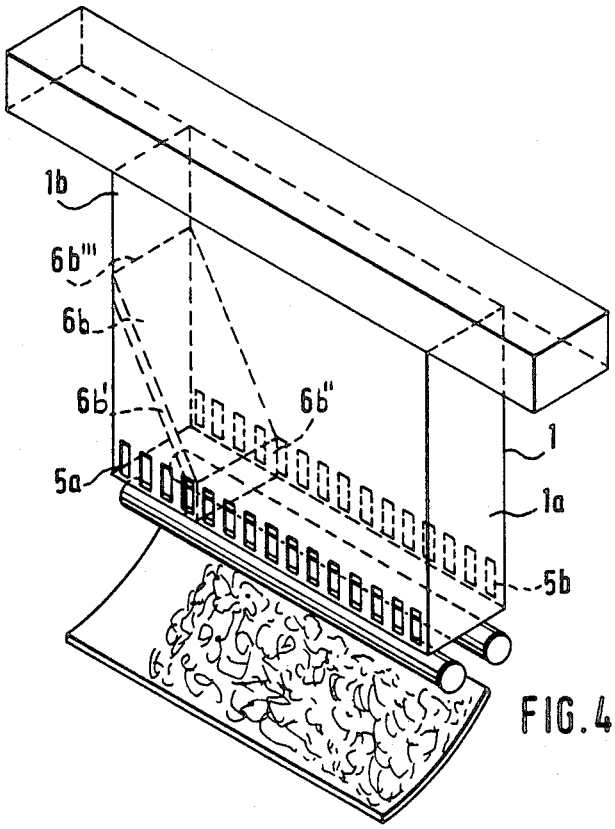
FIG. 4 is a schematic perspective view of still another preferred embodiment of the invention.

According to FIG. 4, lateral edges of the wall element 6*b* are bent angularly at 6*b*′ so that the wall element has an approximately U-shaped cross section. The lower terminal portion 6*b*″ of the wall element 6*b* which is situated in the zone of the air outlet openings 5*a*, 5*b* of the feed chute 1 is oriented parallel to the lateral walls 1*a* and 1*b* of the feed chute 1. The wall element 6*b* may be, in case of a sufficient own weight, supported at its upper zone (edge 6*b*‴) at the wall 1*b*. The lower part 6*b*″ may be supported (by means not shown) at its side on the chute wall where the air outlet openings 5*a*, 5*b* are provided.

Figure 5:
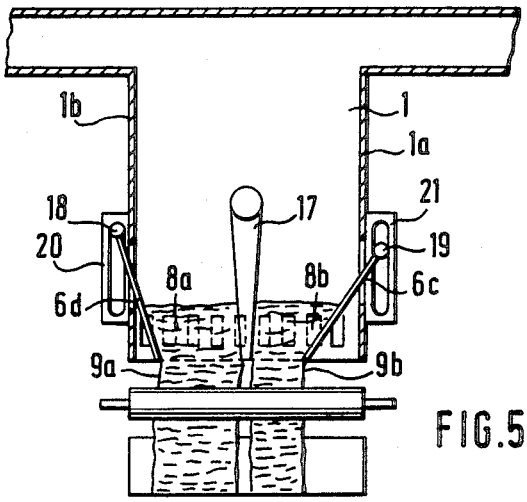
FIG. 5 is a schematic front elevational view of a further preferred embodiment of the invention.

FIG. 5 illustrates a vertical fiber tuft divider 17 which is arranged in the feed chute for dividing it into two partial chutes. The upper, rounded part of the divider 17 may reach approximately to the mid height of the feed chute 1, while the lower zone of the divider 17 extends into the divided fiber tuft columns 8*a*, 8*b* which leave the fiber chute 1 as respective divided laps 9*a*, 9*b*. The lateral walls 1*a* and 1*b* of the feed chute 1 are each associated with a wall element 6*c* and 6*d*, respectively, whose upper respective ends 18 and 19 extend into respective support devices 20 and 21 through non-illustrated slots provided in the lateral walls 1*a* and 1*b*. The support devices 20 and 21 are situated at the outside of the lateral walls 1*a* and 1*b*. The upper ends 18 and 19 of the respective wall elements 6*c* and 6*d* are vertically displaceably arranged in the support elements 20 and 21 so that a varying slope of the wall elements 6*c* and 6*d* and thus a varying width and degree of fiber tuft filling 8*a* and 8*b* of the lap 9*a* and 9*b* may be set. The oblique positioning of the wall elements may be effected in a continuous (stepless) manner.

Figure 6:
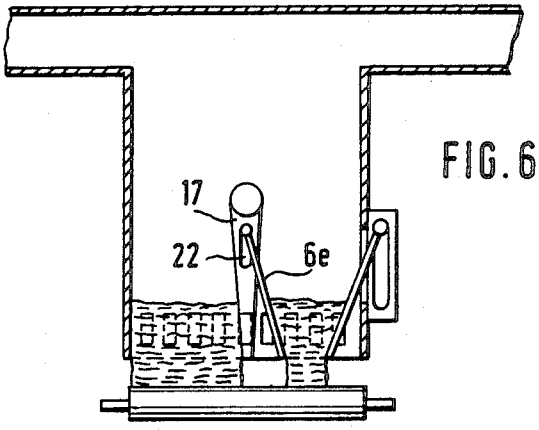
FIG. 6 is a schematic front elevational view of still another preferred embodiment of the invention.

Turning now to FIG. 6, a displaceable wall element 6*e* is associated with the tuft divider 17. The upper end of the wall element 6*e* is vertically displaceably carried in a support element 22 mounted on the divider 17.

Figure 7:
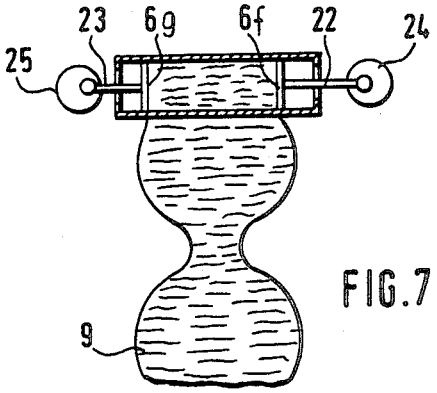
FIG. 7 is a schematic top plan view of one part of a further preferred embodiment of the invention and a fiber lap produced thereby.

FIG. 7 illustrates a feed chute 1 in which two wall elements 6*f* and 6*g* are arranged which are each connected with an externally located eccentric setting device 24, 25 by means of respective coupling elements 22, 23. Dependent upon the setting of the wall elements 6*f*, 6*g*, the width of the lap 9 discharged by the feed chute 1 is varied. In this manner, a fiber lap of predetermined varying contour may be obtained.

Figure 8:
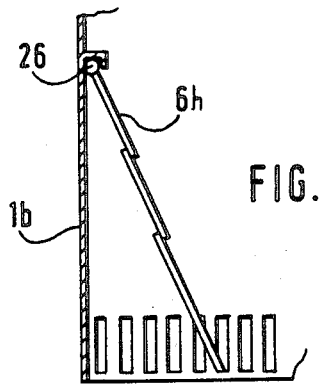
FIG. 8 is a schematic front elevational view of a further preferred embodiment of the invention.

Turning to FIG. 8, the wall element 6*h* is formed of three parts which are displaceable telescopically in their longitudinal direction, so that in this manner the entire length of the wall element 6*h* may be varied. The uppermost part of the wall element 6*h* is mounted by means of a rotary articulation 26 to the lateral wall 1*b* of the feed chute 1. By rotating the articulation 26 and varying the length of the wall element 6*h* the width of the feed chute 1 is varied.

It will be understood that the above description of the present invention is susceptible to various changes, modifications and adaptations, and the same are intended to be comprehended within the meaning and range of equivalents of the appended claims.

What is claimed is:

1. In an apparatus for producing a fiber lap, including a generally vertically oriented feed chute having a width, means for introducing fiber tufts into said feed chute at an upper portion thereof; and means for discharging a continuous fiber lap of predetermined width at a lower portion of said feed chute; the improvement comprising a movable wall element for varying an effective width of said feed chute for altering the width of the fiber lap produced by said apparatus; at least one portion of said movable wall element being situated at said lower portion of said feed chute.

2. An apparatus as defined in claim 1, wherein said movable wall element is situated in said feed chute.

3. An apparatus as defined in claim 2, wherein said feed chute comprises walls; further comprising means defining air outlet openings in at least one of said walls; means for driving air in said feed chute from said upper portion thereof to and out of said air outlet openings; said movable wall element having at least a portion situated at a height level of said air outlet openings.

4. An apparatus as defined in claim 2, wherein said feed chute has front and rear walls, and said movable wall element has opposite lateral edges adjoining respective said front and rear walls of said feed chute.

5. An apparatus as defined in claim 4, wherein said movable wall element has an approximately U-shaped cross section.

6. An apparatus as defined in claim 2, wherein said feed chute has opposite first and second side walls and a lower end and said movable element has top and bottom ends and further wherein said top end of said movable wall element adjoins said first side wall of said feed chute and said bottom end of said movable wall element adjoins said lower end of said feed chute.

7. An apparatus as defined in claim 6, wherein said movable wall element is oriented obliquely downwardly from said first side wall towards said second side wall; said bottom end of said wall element being spaced from said second side wall.

8. An apparatus as defined in claim 7, wherein said wall element has a vertically oriented lower terminal length portion.

9. An apparatus as defined in claim 7, further comprising setting means for varying the position of said movable wall element to adjust an oblique orientation thereof.

10. An apparatus as defined in claim 9, wherein said setting means includes means for steplessly varying the position of said movable wall element.

11. An apparatus as defined in claim 6, wherein said top end of said movable wall element is articulated to said first side wall.

12. An apparatus as defined in claim 11, wherein said movable wall element is formed of a plurality of coplanar, telescopically interconnected wall element parts.

13. An apparatus as defined in claim 2, further comprising a tuft divider situated in said feed chute for dividing the fiber lap.

14. An apparatus as defined in claim 13, wherein said movable wall element is mounted on said tuft divider.

15. An apparatus as defined in claim 1, wherein said feed chute has a lateral vertical wall; further comprising a support plate vertically adjustably mounted on said lateral vertical wall; said movable wall element being articulated to and supported by said support plate, whereby said movable wall element is displaceable vertically with said support plate as a unit.

16. An apparatus as defined in claim 1, wherein said wall element is formed of two spaced wall element parts for bilaterally varying the effective width of said feed chute; further comprising separate setting devices coupled to respective said wall element parts, whereby said wall element parts are settable independently from one another.

* * * * *